US005335901A

United States Patent [19]

Nonomura et al.

[11] Patent Number: 5,335,901

[45] Date of Patent: Aug. 9, 1994

[54] PAPER FEEDER

[75] Inventors: Tomohiro Nonomura; Hiroshi Kishimoto, both of Hyogo, Japan

[73] Assignee: Fujitsu Limited, Kawasaki, Japan

[21] Appl. No.: 11,727

[22] Filed: Feb. 1, 1993

[30] Foreign Application Priority Data

Feb. 6, 1992 [JP] Japan ..... 4-021116

[51] Int. Cl.[5] ..... B65H 3/06

[52] U.S. Cl. ..... 271/117; 271/126; 271/155; 271/157

[58] Field of Search ..... 271/117, 118, 126, 152, 271/153, 155, 157, 160, 147, 145, 273

[56] References Cited

U.S. PATENT DOCUMENTS 3,831,931 8/1974 Tsukamoto .
4,482,148 11/1984 Stewart ..... 271/273
4,552,352 11/1985 Nickels et al. ..... 271/157
4,900,004 2/1990 Ushirogata ..... 271/126

FOREIGN PATENT DOCUMENTS 59-43739 3/1984 Japan .
0212623 9/1988 Japan ..... 271/155
2-43133 2/1990 Japan .
2-62326 3/1990 Japan .
0163228 6/1990 Japan ..... 271/145
3166132 7/1991 Japan ..... 271/147

*Primary Examiner*—H. Grant Skaggs
*Attorney, Agent, or Firm*—Nikaido Marmelstein Murray & Oram

[57] ABSTRACT

A paper feeder capable of reducing its installation space and manufacturing cost, wherein a paper feed table which can be lifted or lowered being held horizontal is provided with an opening section. In order to load paper sheets onto the paper feed table directly from above, the opening section is made openable upwards when the paper feeder is in a paper feeding state during which paper sheets are picked up and fed to a photosensitive drum or similar device. The paper feeder also has a pick-up member for picking up the paper sheets thus loaded onto the paper feed table one after another starting with the top sheet in order to feed them to the photosensitive drum or similar device.

20 Claims, 5 Drawing Sheets

PAPER FEEDER

BACKGROUND OF THE INVENTION (1) Field of the Invention

The present invention relates to a paper feeder for use with various types of electrophotographic devices including facsimiles, printers and copying machines, in which paper sheets stacked on a paper feed table are picked up one after another for feeding, starting with a top sheet.

(2) Description of the Prior Art

In recent years, in order to meet the demand for higher feeding capacity which has been growing with the increase in the speed of the printing process, a paper feeder in which paper sheets are replenished in the following manner is widely used for feeding paper sheets to such an electrophotographic device as mentioned above.

For replenishment of paper sheets, the paper feed table, which is housed in the paper feeder and can be lifted or lowered with paper sheets stacked thereon, is firstly lowered to the lowest position and pulled forwards with the help of sliding rails or similar devices. Then, paper sheets are loaded onto the paper feed table thus pulled out. After the loading, the paper feed table is pushed back with the help of the sliding rails and housed in the paper feeder.

SUMMARY OF THE INVENTION

Such a paper feeder of the so-called pulling-out type requires a space for accommodating the paper feed table which has been pulled forward and this could be a problem in saving installation space. It also has a problem in saving any manufacturing costs. Because, such a paper feeder requires not only sliding rails or similar devices in order to pull the paper feed table out of the paper feeder and push it back thereto, but also a link mechanism which is used for connecting the paper feed table with the driving mechanism for lifting or lowering it and disconnecting the former from the latter, such connection/disconnection taking place when the paper feed table is pulled out of the paper feeder, or when it is pushed back thereto.

One of the objects of the invention is therefore to provide a paper feeder with which not only the installation space but also the manufacturing cost can be saved by overcoming the above disadvantages.

In order to accomplish the foregoing object, a paper feeder according to the invention comprises:

(a) an opening section having an upper part which is openable when the paper feeder is in a paper feeding state during which paper sheets are picked up and fed;

(b) a paper feed table which can be lifted to the opening section or lowered therefrom being held horizontal and onto which the paper sheets are loaded from above through the opening section; and (c) a pick-up member for picking up the paper sheets stacked on the paper feed table one after another for feeding, starting with a top sheet.

As described above, the replenishment of paper sheets is carried out as follows: paper sheets are loaded from above onto the paper feed table that can be lifted towards the opening section or lowered therefrom being held horizontal, through the opening section upper part of which is openable when the paper feeder is in its paper feeding state during which the paper sheets are picked up and fed. The paper sheets thus loaded onto the paper feed table are picked up one after another by the pick-up member starting with the top sheet, in order to feed to a photosensitive drum or other device.

With the above arrangement, the paper sheets to be replenished can be directly loaded from above onto the paper feed table through the opening section upper part of which is openable when the paper feeder is in its paper feeding state. This eliminates the need for a space previously required for accommodating the paper feed table which has been pulled forwards and sliding rails or similar devices, so that installation space and manufacturing costs can be advantageously saved.

In cases where at least a part of the pick-up member projects above the paper sheets stacked on the paper feed table, the part of the pick-up member is preferably retractable from the position above the paper feed table. Similarly, in cases where at least a part of a paper presence/absence detector for detecting the presence/absence of paper sheets on the paper feed table projects above the paper sheets stacked on the paper feed table, the part of the paper presence/absence detector is preferably retractable from the position above the paper feed table concomitantly with the retraction of the part of the pick-up member from the paper feed table. Those retractions facilitate the loading of paper sheets onto the paper feed table from above.

In cases where the opening section is provided with a cover, the part of the pick-up member and the part of the paper presence/absence detector are preferably retractable from their respective positions above the paper feed table concomitantly with the opening of the cover. The above part of the pick-up member may be a pick-up roller, and the above part of the paper presence/absence detector may be a paper absence detection lever. When there is no paper sheet on the paper feed table, the paper absence detection lever downwardly pivots about the axis of a shaft disposed on a side of the paper feed table so that its tip portion is fitted into a hole defined at the paper feed table.

Concretely, the retraction of the pick-up roller and the retraction of the paper absence detection lever, which are concomitant with the opening of the cover, are done in the following manner:

1. the shaft disposed on a side of the paper feed table, for supporting the pick-up roller so as to inhibit the forward and backward rotations of the pick-up roller is rotated, whereby the pick-up roller is allowed to pivot upwardly about the axis of the shaft concomitantly with the opening of the cover with the help of a link mechanism;

2. the shaft disposed on a side of the paper feed table, for supporting the paper absence detection lever so as to allow its forward and backward rotations and the pick-up roller so as to inhibit its forward and backward rotations is rotated, whereby the pick-up roller pivots upwardly about the axis of the shaft concomitantly with the opening of the cover with the help of the link mechanism, whilst the paper absence detection lever pivots upwardly, being engaged with the upwardly pivoting pick-up roller.

In cases where paper sheets are loaded from above onto the paper feed table through the opening section which is openable when the paper feeder is in its paper feeding state during which paper sheets are picked up and fed, the paper feeder preferably comprises:

(a) holding means for holding the paper feed table such that the paper feed table can be lifted or lowered being held horizontal;

(b) feeding level maintaining means for lifting the paper feed table held horizontal by the holding means, for paper feeding, such that a top sheet of paper sheets stacked on the paper feed table is kept at a predetermined feeding level; and (c) loading level maintaining means for lowering the paper feed table held horizontal by the holding means, for loading, such that when paper sheets are not stacked on the paper feed table, the paper feed table is kept at a predetermined loading level that is lower than the feeding level; and such that when paper sheets are stacked on the paper feed table, the top sheet of the paper sheets is kept at the loading level, whereby paper sheets to be replenished can be loaded onto the paper feed table at the loading level. Accordingly, when loading paper sheets from above onto the paper feed table through the opening section, the loading can be performed at a predetermined loading level that is lower than a predetermined feeding level. More specifically, when there is no paper sheet on the paper feed table, paper sheets are loaded onto the paper feed table maintained at the predetermined loading level by the loading level maintaining means. On the other hand, when there are paper sheets stacked on the paper feed table, another supply of paper sheets are stacked on the top sheet of the stacked paper sheets, the top sheet being maintained at the loading level by the loading level maintaining means. Thus, the stacking of paper sheets on the paper feed table can be carried out in a stable condition, thereby facilitating the replenishment operation.

One preferred embodiment of the holding means includes an endless rope at least on each of opposite sides of the paper feed table. Each of the endless ropes is extended in a figure-eight fashion so as to form vertical portions on a plane parallel with an ascending/descending plane of the paper feed table. The paper feed table is horizontally suspended being secured to the vertical portions of the extended endless ropes, whereby the paper feed table is so supported as to be lifted or lowered being kept in a horizontal condition. The endless ropes are wound around a plurality of pairs of pulleys in a figure-eight fashion on the respective sides of the paper feed table. The pulleys constituting a pair are arranged in a vertical direction and a plurality of such pulleys are aligned along both sides of the paper feed table.

In one preferred embodiment of the feeding level maintaining means, an endless rubber belt serves as a belt member. Such feeding level maintaining means comprises:

(a) endless rubber belt(s) extended on a side of the paper feed table in the ascending/descending directions thereof and (each) including an engaging member which is brought into engagement with the underside of the paper feed table; and (b) a driving mechanism for driving the endless rubber belt(s) in the ascending/descending directions of the paper feed table. During paper feeding, the driving mechanism actuates the endless rubber belt(s), with the engaging member(s) of it(them) being engaged with the underside of the paper feed table in order to lift the paper feed table such that the top sheet of paper sheets stacked thereon is maintained at the predetermined feeding level.

In one preferred embodiment of the loading level maintaining means, a tension coil spring serves as an elastic member. Such loading level maintaining means comprises a tension coil spring for imparting an elastic tension force in the ascending direction of the paper feed table. During loading of paper sheets, the paper feed table is lowered against the elastic tension force of the tension coil spring as paper sheets are loaded, whereby when there is no paper sheet on the paper feed table, the paper feed table is kept at the predetermined loading level and whereby when there are paper sheets stacked on the paper feed table, the top sheet of the stacked paper sheets is kept at the predetermined loading level.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, wherein:

FIG. 1 is a view showing the paper feeder according to the invention in service, the paper feeder being of the separation type installed together with an electrophotographic device;

FIG. 2 is a perspective view of the whole construction of the paper feeder of the invention;

FIG. 3 is a schematic view of the mechanism of the paper feeder of the invention;

FIG. 4 is a partially enlarged perspective view of FIG. 2; and

FIG. 5 is a view illustrating an action when a cover shown is opened in FIG. 4.

DESCRIPTION OF THE PREFERRED EMBODIMENT

Figure 1:
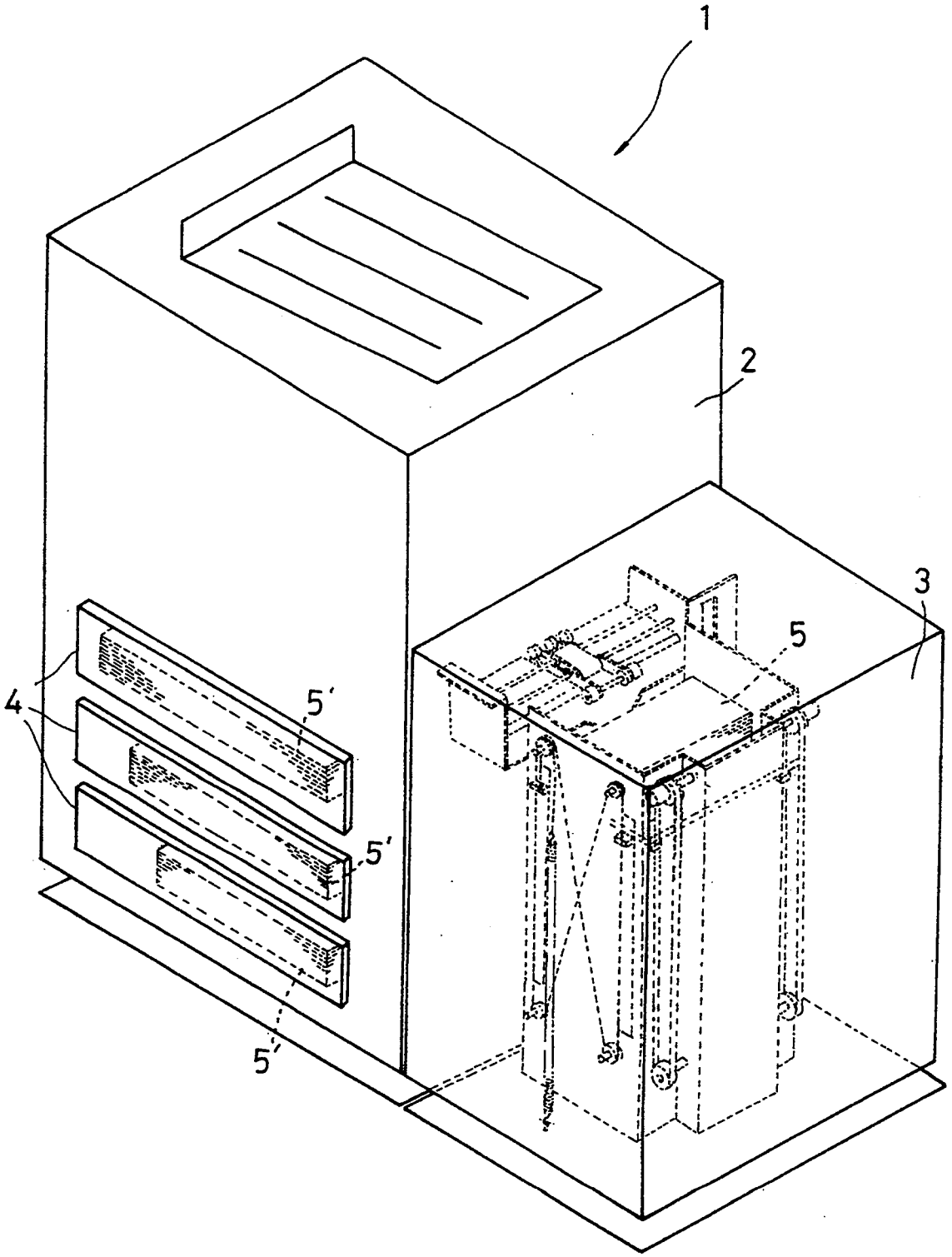
FIGS. 1 through 5 show concrete embodiments of a paper feeder according to the invention.

Referring now to the drawings, concrete embodiments of a paper feeder according to the invention will be hereinafter described.

FIG. 1 shows a main body 2 of an electrophotographic device 1 such as a facsimile, printer or copying machine, and a paper feeder 3 to which the invention is applied. The paper feeder 3 is of the separation type which is constructed separately from the main body 2, and when it is used, it is installed together with the main body 2 as shown in FIG. 1. The main body 2 of the electrophotographic device 1 is also provided with a paper feed tray 4 composed of three cassettes. A stack of paper sheets 5 is stored in the paper feeder 3 and another stack of paper sheets 5' in the paper feed tray 4. Either of the stacks 5, 5' being selected, the paper sheets 5 (5') are sequentially picked up starting with the top sheet and fed to a photosensitive drum (not shown) or other device incorporated within the main body 2. Thereafter, with a known electrophotographic procedure, desired images are transferred by means of the photosensitive drum etc. onto the paper sheets which have been fed, and thus printing, copying etc. are executed.

Figure 2:
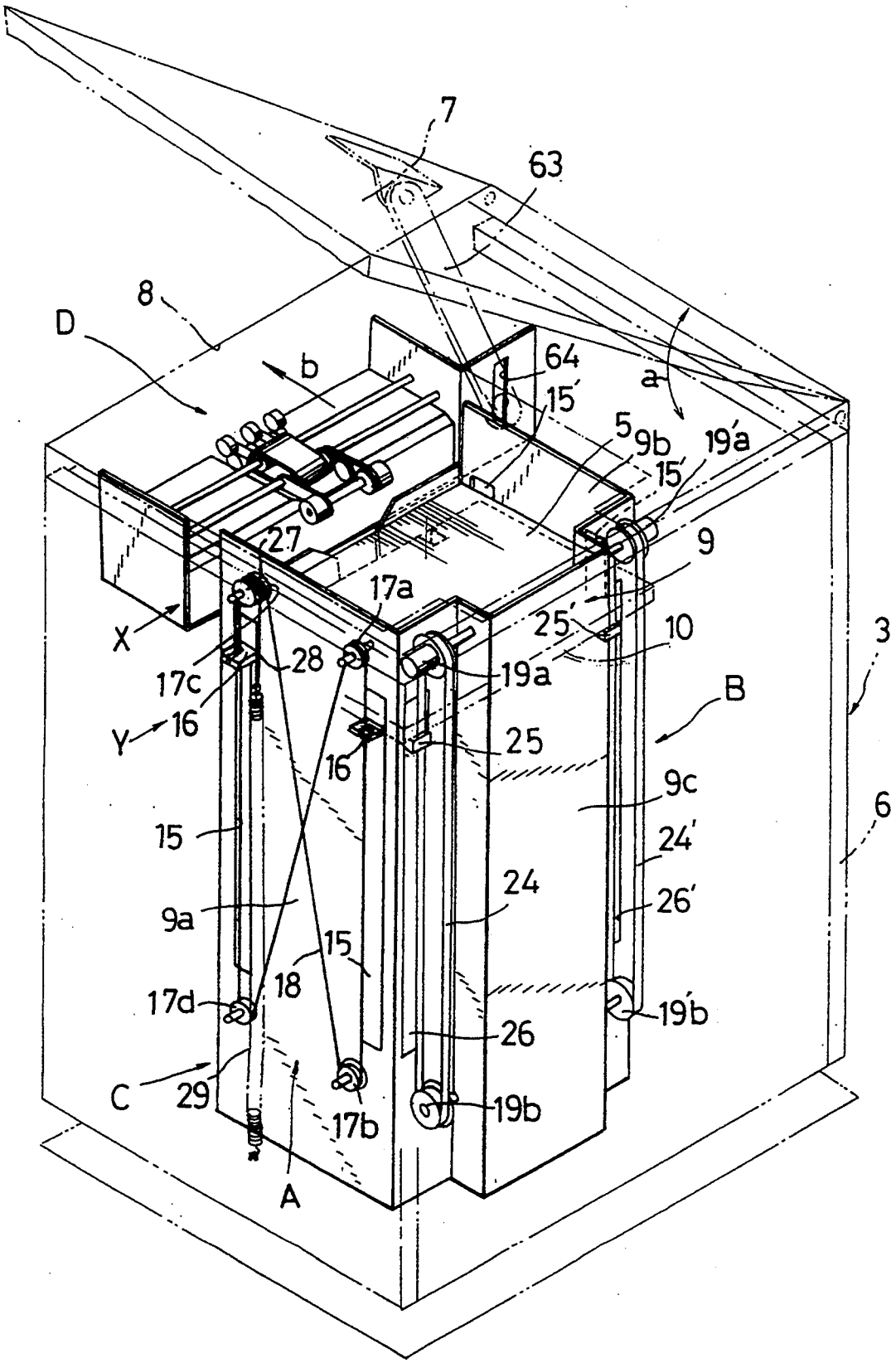

In FIG. 2, the paper feeder 3 to which the invention is applied has a casing 6 in which an opening section 8 is formed at the upper face thereof. Disposed over the opening section 8 is a cover 7 which can be opened or closed in the direction indicated by the arrow a of FIG. 2, so that the opening section 8 is openable when the paper feeder 3 is in its paper feeding condition (shown in FIG. 1) during which the paper sheets are picked up and fed to the main body 2. Incorporated within the casing 6 is a paper hopper 9 that is open at the upper part thereof. Within the paper hopper 9 is a paper feed table 10 loosely fitted in a horizontal condition. There are the paper sheets 5 of a specified size (e.g., A4-size) stacked on the paper feed table 10.

The paper feed table 10 is provided with the following mechanisms:

(1) a holding mechanism A for holding the paper feed table 10 such that it can be lifted or lowered being held horizontal;

(2) a feeding level maintaining mechanism B for lifting the paper feed table 10, for paper feeding, such that the top sheet of the paper sheets 5 stacked thereon is maintained at a feeding level indicated by the arrow X of FIG. 2;

(3) a loading level maintaining mechanism C for lowering the paper feed table 10, for loading, such that when there is no paper sheet on the paper feed table 10, the paper feed table 10 is kept at a loading level indicated by the arrow Y of FIG. 2 that is lower than the feeding level X; and such that when there are the paper sheets 5 stacked on the paper feed table 10, the top sheet of the paper sheets 5 is kept at the loading level Y, whereby paper sheets to be replenished can be loaded onto the paper feed table 10 at the loading level Y.

There is provided a pick-up mechanism D on the paper feeding side of the paper feeder, adjacent to the opening of the paper hopper 9. The pick-up mechanism D picks up the paper sheets 5 stacked on the paper feed table 10 one after another starting with the top sheet and feeds them to the main body 2. There are also provided a paper presence/absence detector (not shown) for detecting whether or not paper sheets are stacked on the paper feed table 10, and a feeding level detector (not shown) which constitutes a part of the feeding level maintaining mechanism B and has the function of detecting whether or not the top sheet of the paper sheets 5 stacked on the paper feed table 10 is kept at the feeding level X.

Figure 3:
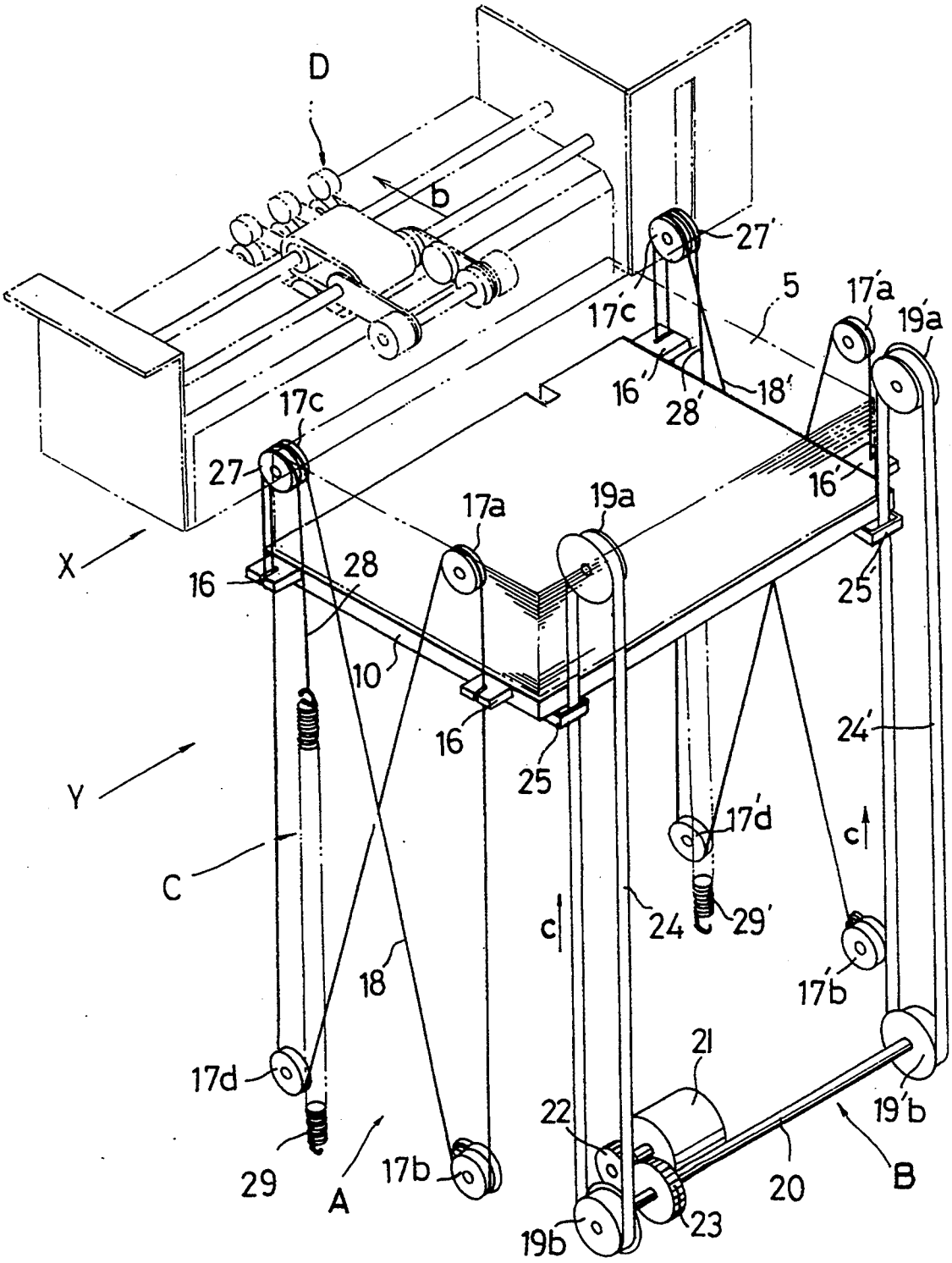

In order to describe the holding mechanism A, the feeding level maintaining mechanism B and the loading level maintaining mechanism C in that order, reference is now made to FIG. 2 and further to FIG. 3 which schematically shows those mechanisms.

(1) Holding mechanism A

The paper hopper 9 is provided with a pair of guide grooves 15 (15') which are aligned in a parallel direction with the paper feeding direction b at each of side walls 9a, 9b of the paper hopper 9, the side walls 9a, 9b being situated at the right and left with respect to the paper feeding direction b. The guide grooves 15 (15') extend in a vertical direction. Projections 16 (16') are provided on each side of the paper feed table 10 loosely fitted in the paper hopper 9, so as to correspond to the guide grooves 15 (15'), the sides being situated at the right and left of the paper feeding direction b. Those projections 16 (16') project, being loosely inserted into the corresponding guide grooves 15 (15'). Each of the side walls 9a, 9b of the paper hopper 9 is provided with pulleys 17a through 17d (17a' through 17d') fixedly attached to the outer face thereof. Specifically, the pulleys in each pair are vertically aligned and two pairs of pulleys 17a and 17b (17a' and 17b'); 17c and 17d (17c' and 17d') are aligned in a parallel direction with the paper feeding direction b. An endless wire rope 18 (18') is extended, being wound around those pairs of pulleys 17a through 17d (17a' through 17d') in figure-eight fashion so as to form vertical portions on a plane parallel with an ascending/descending plane of the paper feed table 10. The paper feed table 10 is suspended being fixed in a horizontal condition at the vertical portions of the endless wire rope 18 (18') by means of the projections 16 (16'). This allows the paper feed table 10 to be lifted to or lowered from the opening section 8, being kept in a horizontal condition.

(2) Feeding level maintaining mechanism B

The paper hopper 9 is provided with two pairs of pulleys 19a, 19b; 19a', 19b' at the outer face of a rear wall 9c, the rear wall 9c while being situated on a side opposite to the feeding side. Specifically, the pulleys in each pair are aligned vertically. The pair of pulleys 19a, 19b is situated at the left; the pair of pulleys 19a', 19b' is at the right with respect to the paper feeding direction b. Of those pulleys 19a, 19b, 19a' and 19b', the upper pulleys 19a, 19a' are independently fixed to the rear wall 9c of the paper hopper 9 whilst the lower pulleys 19b, 19b' are coupled to a common rotary shaft 20. The rotary shaft 20 is so supported at the rear wall 9c of the paper hopper 9 as to pivot in forward and backward directions. The rotary shaft 20 is provided with a coaxial gear 23 which meshes with a gear 22 of a driving motor 21 so that the forward and backward rotations of the driving motor 21 are transmitted to the pulleys 19b, 19b'. An endless rubber belt 24 is extended being wound around the pair of vertically aligned pulleys 19a, 19b, and another endless rubber belt 24' is extended being wound around the pair of vertically aligned pulleys 19a', 19b'. The endless rubber belts 24, 24' have engaging pieces 25, 25' respectively. Those engaging pieces 25, 25' project from the endless rubber belts 24, 24', being loosely inserted into guide grooves 26, 26' respectively so that they can be engaged with the underside of the paper feed table 10. The guide grooves 26, 26' are defined at the right and left of the paper feeding direction b in the rear wall 9c of the paper hopper 9 such that they correspond to the engaging pieces 25, 25' respectively and extend vertically. For paper feeding, the driving motor 21 forwardly rotates, thereby moving the endless rubber belts 24, 24' in a forward direction c shown in FIG. 3. This movement causes the engaging pieces 25, 25' attached to the endless rubber belts 24, 24' to move upwards and then be brought into engagement with the underside of the paper feed table 10. The paper feed table 10 engaged with the engaging pieces 25, 25' is lifted until the feeding level detector detects that the top sheet of the paper sheets 5 stacked on the paper feed table 10 has reached the feeding level X and the driving motor 21 is stopped. As the paper sheets 5 are picked up, the driving motor 21 is actuated in the forward direction, based on the detection by the feeding level detector as to whether or not the top sheet is positioned at the feeding level X. Consequently, the paper feed table 10 is lifted such that the top sheet is maintained at the feeding level X.

(3) Loading level maintaining mechanism C

The paper hopper 9 is provided with pulleys 27, 27' which have the same axes as those of the pulleys 17, 17' of the holding mechanism A respectively, the pulleys 17, 17' being located at upper positions (closer to the paper feeding side) on the respective outer faces of the side walls 9a, 9b of the paper hopper 9. Wound around the pulleys 27 (27') is a wire rope 28 (28') one end of which is so suspended as to be secured to the projection 16 (16') of the paper feed table 10. The other end of the wire rope 28 (28') is suspended so as to be connected to one end of a tension coil spring 29 (29'). The other end of the tension coil spring 29 (29') is fixed to the bottom of the casing 6. The tension coil spring 29 (29') has a spring constant with which a lifting force is applied to the paper feed table 10 such that when there is no paper sheet on the paper feed table 10, the paper feed table 10 is maintained at the loading level Y and such that when there are paper sheets stacked on the paper feed table 10, the top sheet of the stacked paper sheets 5 is maintained at the loading level Y. For loading paper sheets, the driving motor 21 of the feeding level maintaining mechanism B is actuated in the backward direction, thereby moving the end-less rubber belts 24, 24' in a direction opposite to the forward direction c shown in FIG. 3. This causes the engaging pieces 25, 25' attached to the endless rubber belts 24, 24' to be lowered so that the engaging pieces 25, 25' are released from the engagement with the paper feed table 10. Consequently, the paper feed table 10 is lowered until the paper feed table 10 reaches the loading the level Y when there is no paper sheet thereon or until the top sheet of the stacked paper sheets 5 reaches the loading level Y when there are paper sheets stacked on the paper feed table 10. Upon completion of the loading of the paper sheets onto the paper feed table 10, the paper feed table 10 is lowered again so that the top sheet of the loaded paper sheets comes to the loading level Y.

Figure 4:
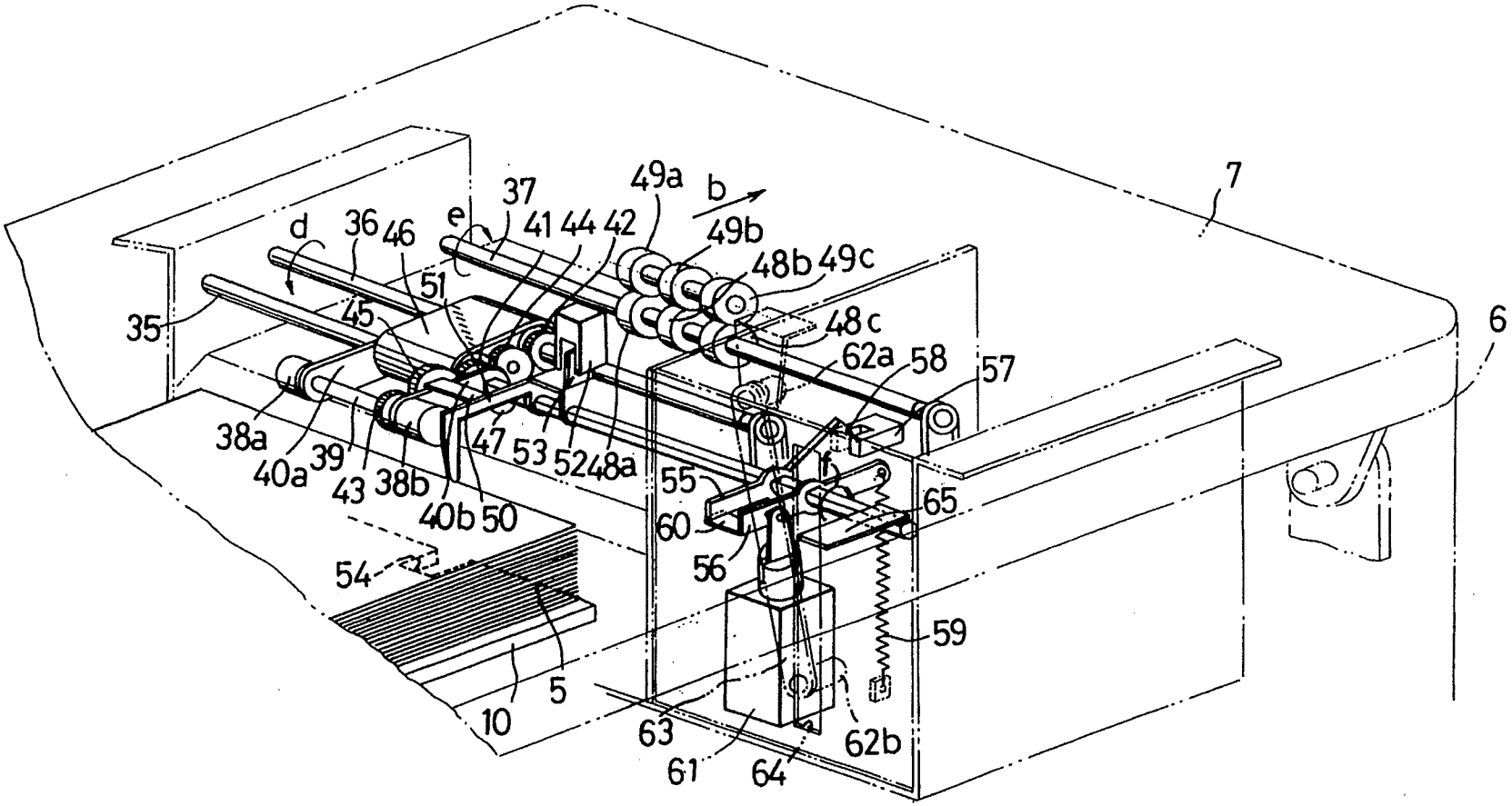

With reference to FIG. 4 showing a partially enlarged perspective view, the pick-up mechanism D, the paper presence/absence detector, the feeding level detector will be described in that order.

(a) Pick-up mechanism D

On the paper feeding side on a side of the paper feed table 10, there are a first rotary shaft 35, a second rotary shaft 36, a third rotary shaft 37 disposed in order in the paper feeding direction b viewed from the paper feed table 10. The second rotary shaft 36 and the third rotary shaft 37 are driven by different driving motors (not shown). The first through third rotary shafts 35, 36, 37 are so supported at positions on the casing 6 side as to rotate in the forward and backward directions. The first rotary shaft 35 is provided with a pair of pick-up rollers 38a, 38b which project above the paper sheets stacked on the paper feed table 10 and are brought into contact with the top sheet from above by their own weight, when they are in operation. The pick-up rollers 38a, 38b have a common rotary shaft 39 which is supported by supporting arms 40a, 40b at the respective ends of the arms 40a, 40b so as to rotate forwardly and backwardly, and the other ends of the supporting arms 40a, 40b are secured to the first rotary shaft 35, whereby the pick-up rollers 38a, 38b are supported by the first rotary shaft 35 with the help of the supporting arms 40a, 40b so as not to rotate forwardly and backwardly in relation to the first rotary shaft 35. The rotary movement is transmitted in turn from the second rotary shaft 36 to the pick-up rollers 38a, 38b by way of gears 41 to 43 secured to the first and second rotary shafts 35, 36 and the common rotary shaft 39, and intermediate gears 44, 45 that are disposed between the gears 41 through 43, being in mesh therewith. An endless feed belt 46 is extended, being wound around the first and second rotary shafts 35, 36 such that the endless feed belt 46 slides freely in relation to the first rotary shaft 35. A driven roller 47 is disposed facing to the underside of the endless feed belt 46. Three delivery rollers 48a through 48c are secured to the third rotary shaft 37, and driven rollers 49a through 49c are disposed over the delivery rollers 48a through 48c facing thereto. The second and third rotary shafts 36, 37 are intermittently rotated in the direction of the arrow d and the direction of the arrow e (shown in FIG. 4) respectively by means of the aforesaid different driving motors in such a manner that the latter rotates slower than the former. With such an arrangement, the paper sheets stacked on the paper feed table 10 are picked up from the top sheet by means of the pick-up rollers 38a, 38b. After being picked up, the paper sheets are gripped between the endless feed belt 46 and the driven roller 47 and then between the delivery rollers 48a through 48c and the driven rollers 49a through 49c so as to be delivered to the main body 2 of the electrophotographic device.

(b) Paper presence/absence detector

The first rotary shaft 35 is also provided with a paper absence detection lever 51 that is so supported as to rotate forwardly and backwardly in relation to the first rotary shaft 35. The paper absence detection lever 51 has an engaging piece 50 integrally formed therewith. The engaging piece 50 is able to come in contact with the upper end (shown in FIG. 4) of the supporting arm 40b from above, the supporting arm 40b being one of the arms which support the common rotary axis 39 of the pick-up rollers 38a, 38b, and this contact permits the engaging piece 50 to be engaged with the supporting arm 40b. A paper absence sensor 52 is provided in connection with the paper absence detection lever 51. The paper absence sensor 52 is comprised of a light emitting element and a light receiving element for receiving light emitted from the light emitting element. A light interrupting segment 53 is integrally formed with the paper absence detection lever 51. This light interrupting segment 53 has the function of interrupting light sent from the light emitting element to the light receiving element, being positioned between them when there are paper sheets stacked on the paper feed table 10. The paper feed table 10 is provided with a hole 54 defined at a position opposite to the tip portion of the paper absence detection lever 51 so that the tip portion can be fitted into the hole 54. When there are paper sheets on the paper feed table 10, the paper absence detection lever 51, which projects above the paper sheets on the paper feed table 10 during paper feeding like the pick-up rollers 38a, 38b etc., is prevented from pivoting downwards by its own weight because the stack of paper sheets prevents its tip portion from being fitted into the hole 54. This allows the light interrupting segment 53 of the paper absence detection lever 51 to remain between the light emitting element and the light receiving element of the paper absence sensor 52. When the paper sheets on the paper feed table 10 run out, the paper absence detection lever 51 pivots downwards owing to its own weight about the axis of the first rotary shaft 35 because no paper prevents the tip portion from fitting into the hole 54. As a result, the tip portion fits in the hole 54 defined in the paper feed table 10, causing the light interrupting segment 53 to move from the position between the light emitting element and the light receiving element of the paper absence sensor 52. Thus, no paper sheet on the paper feed table 10 is detected.

(c) Feeding level detector

Figure 5:
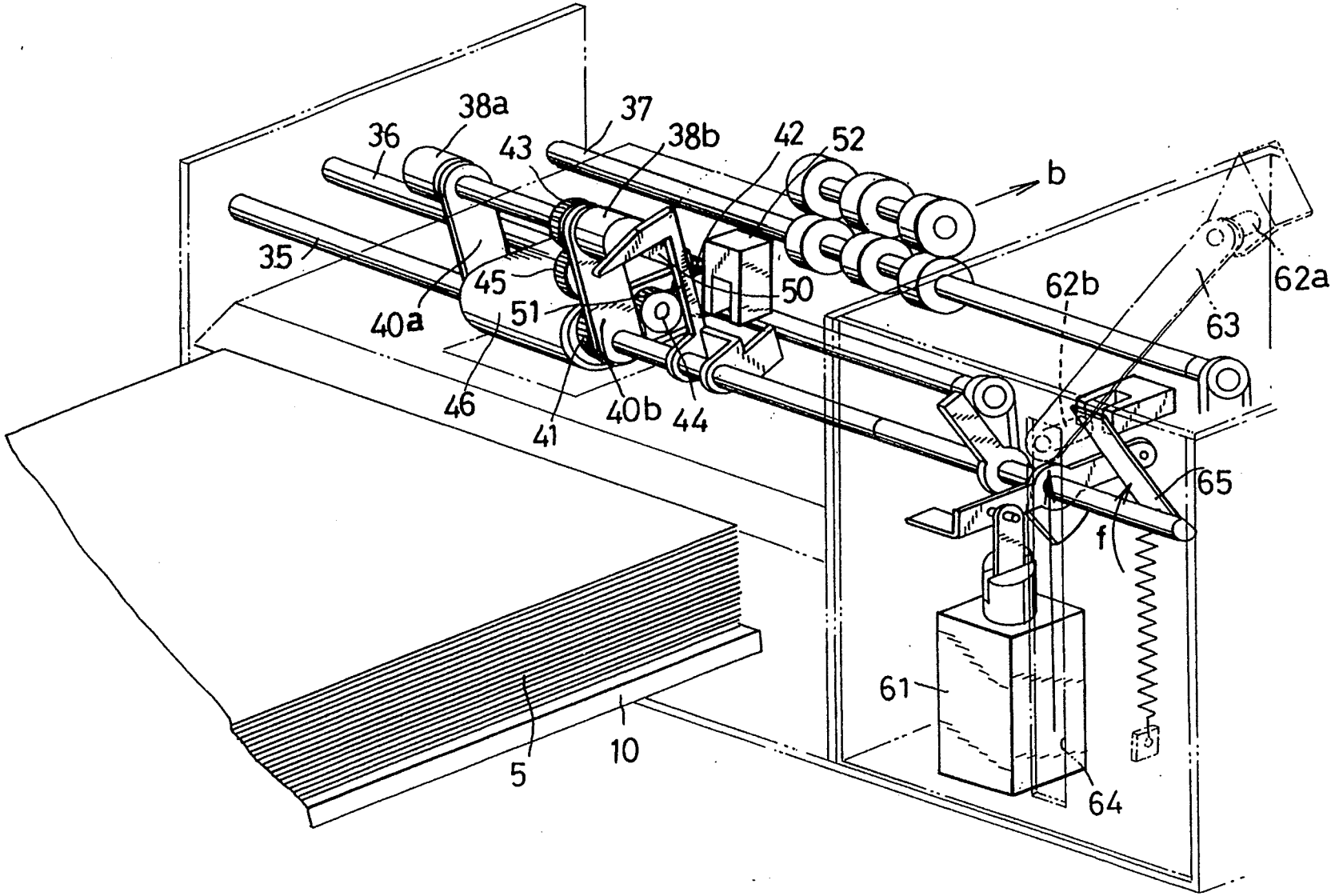

The first rotary shaft 35 is also provided with a feeding level detection lever 55 and a feeding level detection release lever 56. Those levers 55, 56 are away from the paper feed table 10 rightward with respect to the paper feeding direction b. More specifically, the feeding level detection lever 55 is supported at the centre thereof so as not to rotate forwardly and backwardly in relation to the first rotary shaft 35, whilst the feeding level detection release lever 56 is supported at the centre thereof so as to rotate forwardly and backwardly in relation to the same. On the downstream side of the feeding level detection lever 55 with respect to the paper feeding direction b, there is provided a feeding level sensor 57 composed of a light emitting element and a light receiving element for receiving light emitted from the light emitting element. When the top sheet of the paper sheet 5 stacked on the paper feed table 10 is at the feeding level X, a piece 58 formed at one end of the feeding level detection lever 55 is positioned between the light emitting element and the light receiving element of the feeding level sensor 57. On the downstream side of the feeding level detection release lever 56 with respect to the paper feeding direction b, there is provided a tension coil spring 59 for energizing the feeding level detection release lever 56 to pivot in a direction indicated by the arrow f of FIG. 4. On the upstream side of the feeding level detection release lever 56 with respect to the paper feeding direction b, there is provided an interlocking piece 60 integrally formed with the feeding level detection release lever 56. When the tension coil spring 59 causes the pivoting of the feeding level detection release lever 56 in the direction of the arrow f, the interlocking piece 60 comes in contact with the underside of one end of the feeding level detection lever 55 to be interlocked therewith in order to raise the feeding level detection lever 55 in the direction of the arrow f. The feeding level detection release lever 56 is connected, at the downstream side thereof, to a plunger 61 which is actuated only during paper feeding and during feeding level detection, and releases the feeding level detection release lever 56 from the interlocking with the feeding level detection lever 55 by rotating the feeding level detection release lever 56 against the energizing force of the tension coil spring 59 in the opposite direction to the direction of the arrow f. When the plunger 61 is not operative (i.e., during a time when neither paper feeding nor feeding level detection are executed), the tension coil spring 59 energizes the feeding level detection release lever 56 to pivot so that the feeding level detection lever 55 is interlocked with the interlocking piece 60 of the feeding level detection release lever 56 and is raised in the direction of the arrow f as shown in FIG. 5. Then, the pick-up rollers 38*a*, 38*b* etc. are raised by the first rotary shaft 35 so that they are suspended above the top sheet of the paper sheets stacked on the paper feed table 10. On the other hand, when the plunger 61 is operative (i.e., during paper feeding or during feeding level detection), the feeding level detection lever 55 is released from its raised condition, the raising being a result of from the interlocking by the interlocking piece 60 of the feeding level detection release lever 56. Then, the pick-up rollers 38*a*, 38*b* are brought into contact with the top sheet of the paper sheets on the paper feed table 10 from above because of their own weight. At that time, if the piece 58 formed at one end of the feeding level detection lever 55 is positioned between the light emitting element and the light receiving element of the feeding level sensor 57, it is detected that the top sheet is at the feeding level X, and if not, it is detected that the top sheet is not at the feeding level X.

There is a link 63 interposed between the casing 6 and the cover 7. The link 63 has projections 62*a*, 62*b* at both ends of one face thereof, and is pivotally supported on the cover 7 with the projection 62*a*. The projection 62*b* is loosely inserted into a guide groove 64 defined in a vertical direction in the casing 6 side in such a manner that: as the cover 7 is opened in the direction of the arrow a of FIG. 2, the projection 62*b* is guided to move upwards from the bottom of the guide groove 64; and as the cover 7 is closed in the direction of the arrow a, the projection 62*b* is guided to move downwards from the top of the guide groove 64. The first rotary shaft 35 is provided with a flipping board 65 secured at the end thereof, the end being situated at the right hand with respect to the paper feeding direction b. As shown in FIG. 5, in the course of the upward movement of the projection 62*b* through the guide groove 64, the projection 62*b* flips the flipping board 65 upwards as the projection 62*b* moves upwards, with the result that the first rotary shaft 35 rotates in the direction of the arrow f. Accordingly, the first rotary shaft 35 is rotated in the direction of the arrow f concomitantly with the opening of the cover 7. This rotation is transmitted to the pick-up rollers 38*a*, 38*b* through the supporting arms 40*a*, 40*b* and to the paper absence detection lever 51 engaged with the supporting arm 40*b*, so that the pick-up rollers 38*a*, 38*b* and the paper absence detection lever 51 pivot upwards about the axis of the first rotary shaft 35. As a result, the pick-up rollers 38*a*, 38*b* and the paper absence detection lever 51 are retracted from their respective positions above the paper feed table 10, which facilitates the operation of loading paper sheets onto the paper feed table 10 from above. The opening of the cover 7 turns an interlock switch off, thereby bringing the sensors and driving motors etc. into their inoperative conditions.

The invention applied to a paper feeder of the separation type which is installed separately from the main body of an electrophotographic device has been particularly described hereinabove, but it is obvious that the invention may be applied to a paper feeder integral with the main body of an electrophotographic device.

Although the above embodiment employs two pairs of pulleys 17*a* through 17*d* (17*a*' through 17*d*') provided at each of the sides (situated at the right and left of the paper feeding direction b) of the paper hopper, the pulleys in each pair being vertically aligned, and the two pairs being arranged along the paper feeding direction b, the invention is not necessarily limited to this. Alternatively, three pairs of pulleys may be provided on both sides. Further, four pairs of pulleys or more may be provided on both sides.

The paper feed table 10 is held horizontal by the use of a pair of endless rubber belt 24, 24' in the above embodiment, but it is also possible to adopt such an arrangement that one endless rubber belt is used and a common rotary shaft is provided for a pair of opposite pulleys, for example, the pulleys 17*b*, 17*b'*.

The endless wire ropes 18, 18' employed in the embodiment may be extended in the form of a ring, or wire ropes each of which is connected at the projections 16 (16') of the paper feed table 10 may be used. Instead of the endless wire ropes 18, 18', endless fabric ropes may be used. Although the endless rubber belt 24, 24' are employed in the embodiment, endless chains can be employed instead of those belts.

The invention being thus described, it will be obvious that the same may be varied in many ways. Such variations scope of the invention, and all such modifications as would be obvious to one skilled in the art are intended to be included within the scope of the following claims.

What is claimed is:

1. A paper feeder, comprising:

(a) an opening section having an upper part which is openable when the paper feeder is in a paper feeding state during which paper sheets are picked up and fed by a pick-up member, wherein a cover is provided at the opening section which is openable/closeable comprising a rotating axis in a direction parallel to a paper feeding direction of the sheets;

(b) a paper feed table which can be lifted to the opening section or lowered therefrom being held horizontal and onto which paper sheets are loaded only from above through the opening section; and (c) said pick-up member for picking up the paper sheets stacked on the paper feed table one after another for feeding, starting with a top sheet.

2. The paper feeder as claimed in claim 1, wherein at least a part of the pick-up member projects to a position above the paper sheets stacked on the paper feed table, and is retractable therefrom.

3. The paper feeder as claimed in claim 2, wherein the retraction of the part of the pick-up member from the position above the paper feed table is done, by allowing the part to pivot upwardly about the axis of a shaft located on a side of the paper feed table.

4. The paper feeder as claimed in claim 1, wherein a part of the pick-up member projects to a position above the paper sheets stacked on the paper feed table, and is retractable therefrom.

5. The paper feeder as claimed in any one of claims 2 or 4, wherein the part of the pick-up member is a pick-up roller.

6. A paper feeder, comprising:

(a) an opening section having an upper part which is openable when the paper feeder is in a paper feeding state during which paper sheets are picked up and fed;

(b) a paper feed table which can be lifted to the opening section or lowered therefrom being held horizontal and onto which the paper sheets are loaded from above through the opening section;

(c) a pick-up member for picking up the paper sheets stacked on the paper feed table one after another for feeding, starting with a top sheet, wherein at least a part of the pick-up member projects to a position above the paper sheets stacked on the paper feed table, and is retractable therefrom; and (d) a paper presence/absence detector having at least a part which projects to a position above the paper sheets stacked on the paper feed table, for detecting the presence/absence of the paper sheets stacked on the paper feed table and said part is retractable from said position concomitantly with the retraction of the part of the pick-up member from the position above the paper feed plate.

7. The paper feeder as claimed in claim 6, wherein the retraction of the part of the paper presence/absence detector from the position above the paper feed table is done by allowing the part of the paper presence/absence detector to pivot upwardly about the axis of the shaft located on the side of the paper feed table, being engaged with the part of the pick-up member which pivots about the axis.

8. The paper feeder as claimed in claims 6 or 7, wherein the opening section comprises a cover.

9. A paper feeder, comprising:

(a) an opening section having an upper part which is openable when the paper feeder is in a paper feeding state during which paper sheets are picked up and fed;

(b) a paper feed table which can be lifted to the opening section or lowered therefrom being held horizontal and onto which the paper sheets are loaded from above through the opening section; and (c) a pick-up member for picking up the paper sheets stacked on the paper feed table one after another for feeding, starting with a top sheet, wherein a part of the pick-up member projects to a position above the paper sheets stacked on the paper feed table, and is retractable therefrom concomitantly with opening of a cover provided at the opening section, and the retraction of the part of the pick-up member from the position above the paper feed table is done in such a way that a shaft located on a side of the paper feed table and adopted to support the part of the pick-up member so as not to rotate forwardly and backwardly is rotated concomitantly with opening of the cover so that a link mechanism allows the part of the pick-up member to pivot upwardly about the axis of the shaft.

10. A paper feeder, comprising:

(a) an opening section having an upper part which is openable when the paper feeder is in a paper feeding state during which paper sheets are picked up and fed;

(b) a paper feed table which can be lifted to the opening section or lowered therefrom being held horizontal and onto which the paper sheets are loaded from above through the opening section;

(c) a pick-up member for picking up the paper sheets stacked on the paper feed table one after another for feeding, starting with a top sheet, wherein a part of the pick-up member projects to a position above the paper sheets stacked on the paper feed table, and is retractable therefrom concomitantly with opening of a cover provided at the opening section; and (d) a paper presence/absence detector having at least a part which projects to a position above the paper sheets stacked on the paper feed table, for detecting the presence/absence of the paper sheets stacked on the paper feed table and said part is retractable from said position concomitantly with the retraction of the part of the pick-up member from the position above the paper feed table, the retraction of the part of the pick-up member being concomitant with opening of the cover.

11. The paper feeder as claimed in claim 10, wherein the retraction of the part of the paper presence/absence detector from the position above the paper feed table is done in such a way that a shaft located on a side of the paper feed table and adopted to support the part of the paper presence/absence detector so as to rotate forwardly and backwardly and the part of the pick-up member so as not to rotate forwardly and backwardly is rotated concomitantly with opening of the cover so that a link mechanism allows the part of the pick-up member to pivot upwardly about the axis of the shaft, together with the part of the paper presence/absence detector engaged with the upwardly pivoting part of the pick-up member.

12. The paper feeder as claimed in any one of claims 6 or 10, wherein the part of the paper presence/absence detector is a paper absence detection lever which pivots downwardly so that its tip portion is fitted into a hole defined at the paper feed table when there is no paper sheet stacked on the paper feed table, and the part of the pick-up member is a pick-up roller.

13. A paper feeder, wherein paper sheets stacked on a paper feed table are picked up one after another for feeding, starting with a top sheet, comprising:

(a) holding means for holding the paper feed table such that the paper feed table can be lifted or lowered being held horizontal;

(b) feeding level maintaining means for lifting the paper feed table held horizontal by the holding means, for paper feeding, such that the top sheet of the paper sheets stacked on the paper feed table is kept at a predetermined feeding level;

(c) loading level maintaining means for lowering the paper feed table held horizontal by the holding means, for loading, such that when there is no paper sheet stacked on the paper feed table, the paper feed table is kept at a predetermined loading level that is lower than the feeding level, and such that when paper sheets are stacked on the paper feed table, the top sheet of the paper sheets is kept at the loading level, whereby paper sheets to be replenished can be loaded onto the paper feed table at the loading level; and (d) an opening section that is openable upwards when the paper feeder is in a paper feeding state during which the paper sheets are picked up and fed, wherein the paper sheets are loaded from a vertical direction through the opening section, and when there is no paper sheet on the paper feed table, the paper sheets are loaded onto the paper feed table kept at the predetermined loading level by the loading level maintaining means, and further when there are paper sheets stacked on the paper feed table, the paper sheets are loaded onto the top sheet of the stacked paper sheets, the top sheet being kept at the predetermined loading level by the loading level maintaining means.

14. A paper feeder, wherein paper sheets stacked on a paper feed table are picked up one after another for feeding, starting with a top sheet, comprising:

(a) holding means for holding the paper feed table such that the paper feed table can be lifted or lowered being held horizontal;

(b) feeding level maintaining means for lifting the paper feet table held horizontal by the holding means, for paper feeding, such that the top sheet of the paper sheets stacked on the paper feed table is kept at a predetermined feeding level;

(c) loading level maintaining means for lowering the paper feed table held horizontal by the holding means, for loading, such that when there is no paper sheet stacked on the paper feed table, the paper feed table is kept at a predetermined loading level that is lower than the feeding level, and such that when paper sheets are stacked on the paper feed table, the top sheet of the paper sheets is kept at the loading level, whereby paper sheets to be replenished can be loaded onto the paper feed table at the loading level; and (d) a cover provided at the opening section which is openable/closable comprising a rotating axis in a direction parallel to a paper feeding direction of the paper sheets.

15. A paper feeder, wherein paper sheets stacked on a paper feed table are picked up one after another for feeding, starting with a top sheet, said paper feeder comprising:

(a) holding means for holding the paper feed table such that the paper feed table can be lifted or lowered being held horizontal;

(b) feeding level maintaining means for lifting the paper feed table held horizontal by the holding means, for paper feeding, such that the top sheet of the paper sheets stacked on the paper feed table is kept at a predetermined feeding level;

(c) loading level maintaining means for lowering the paper feed table held horizontal by the holding means, for loading, such that when there is no paper sheet stacked on the paper feed table, the paper feed table is kept at a predetermined loading level that is lower than the feeding level, and such that when paper sheets are stacked on the paper feed table, the top sheet of the paper sheets is kept at the loading level, whereby paper sheets to be replenished can be loaded onto the paper feed table at the loading level, wherein the feeding level maintaining means comprises (a) belt member extended on a side of the paper feed table in the ascending/descending direction thereof and including an engaging member which is brought into engagement with the underside of the paper feed table and (b) a driving mechanism for driving the belt member in the ascending/descending direction of the paper feed table, and for paper feeding, the driving mechanism actuates the belt member, with the engaging member of the belt member being engaged with the underside of the paper feed table in order to lift the paper feed table such that the top sheet of the paper sheets stacked thereon is maintained at the predetermined feeding level.

16. The paper feeder as claimed in claim 15, wherein the belt member is an endless rubber belt which is wound around a pair of pulleys, the pulleys being vertically aligned on the side of the paper feed table.

17. A paper feeder, wherein paper sheets stacked on a paper feed table are picked up one after another for feeding, starting with a top sheet, said paper feeder comprising:

(a) holding means for holding the paper feed table such that the paper feed table can be lifted or lowered being held horizontal;

(b) feeding level maintaining means for lifting the paper feed table held horizontal by the holding means, for paper feeding, such that the top sheet of the paper sheets stacked on the paper feed table is kept at a predetermined feeding level;

(c) loading level maintaining means for lowering the paper feed table held horizontal by the holding means, for loading, such that when there is no paper sheet stacked on the paper feed table, the paper feed table is kept at a predetermined loading level that is lower than the feeding level, and such that when paper sheets are stacked on the paper feed table, the top sheet of the paper sheets is kept at the loading level, whereby paper sheets to be replenished can be loaded onto the paper feed table at the loading level, wherein the loading level maintaining means comprises an elastic member for imparting an elastic tension force in the ascending direction of the paper feed, and wherein for loading, the paper feed table is lowered against the elastic tension force of the elastic member as paper sheets are loaded, such that when there is no paper sheet on the paper feed table, the paper feed table is kept at the predetermined loading level and such that when there are paper sheets stacked on the paper feed table, the top sheet of the paper sheets is kept at the predetermined loading level.

18. The paper as claimed in claim 17, wherein the holding means has an endless rope at least on each of opposite sides of the paper feed table, each of the endless ropes being extended in figure-eight fashion so as to form vertical portions on a plane parallel with an ascending/descending plane of the paper feed table, and the paper feed table is suspended in a horizontal condition, being secured to the vertical portions of the respective endless ropes thus extended, whereby the paper feed table is so supported as to be lifted or lowered being held horizontal.

19. The paper feeder as claimed in claim 18, wherein the endless ropes are wound around a plurality of pairs of pulleys disposed on the respective sides of the paper feed table in figure-of-eight fashion, the pulleys in each pair being aligned vertically and the pairs being aligned along both of the sides.

20. The paper feeder as claimed in claim 17, wherein the elastic member is a tension coil spring.

* * * * *